United States Patent [19]

Minkkinen

[11] Patent Number: 4,824,445

[45] Date of Patent: Apr. 25, 1989

[54] METHOD FOR RECYCLING IN A CRUDE OIL STABILIZATION INSTALLATION, WHICH IMPROVES THE PRODUCTION OF LIQUEFIED PETROLEUM GAS COMING FROM THE ASSOCIATED GASES

[75] Inventor: Ari Minkkinen, St. Nom La Breteche, France

[73] Assignees: Total Compagnie Francaise des Petroles, Paris, France; Abu Dhabi Gas Industries Limited, United Arab Emirates

[21] Appl. No.: 149,319

[22] Filed: Jan. 28, 1988

[30] Foreign Application Priority Data

Jan. 28, 1987 [FR] France ..... 87 00981

[51] Int. Cl.[4] ..... B01D 19/00

[52] U.S. Cl. ..... 55/40; 55/43; 55/46; 55/51; 208/352; 208/361

[58] Field of Search ..... 55/38, 40, 43, 46, 48, 55/51, 55; 208/351, 352, 361, 364

[56] References Cited

U.S. PATENT DOCUMENTS

| | | | |
|---|---|---|---|
| 3,702,296 | 11/1972 | Arnold et al. | 208/361 X |
| 4,116,821 | 9/1978 | Peiser | 208/361 |
| 4,369,047 | 1/1983 | Arscott et al. | 55/38 |

*Primary Examiner*—Charles Hart

*Attorney, Agent, or Firm*—Sughrue, Mion, Zinn, Macpeak, and Seas

[57] ABSTRACT

A method for recycling gas in an installation for the stabilization of crude oil (1) containing gas/liquid separation stages (2, 3, 4) whose gas removal pipes (12, 13, 14) are connected to the intake of a gas treatment installation (18) which provides a current of rich gas (19) and a current of poor residual gas (20), characterized in that an adjustable part (21, 22) of the poor residual gas current is injected into the flow of crude oil (8), preferably between the penultimate (3) and last (4) gas/liquid separation stage, of the installation for stabilization of crude oil (1), in order to increase the production of liquified petroleum gas and condensates.

2 Claims, 7 Drawing Sheets

METHOD FOR RECYCLING IN A CRUDE OIL STABILIZATION INSTALLATION, WHICH IMPROVES THE PRODUCTION OF LIQUEFIED PETROLEUM GAS COMING FROM THE ASSOCIATED GASES

The invention relates to crude oil stabilization installations containing a plurality of gas/liquid separation stages, in which the first stage receives the crude oil produced by an oil well and in which the last stage provides stabilized oil, with each stage being provided with gas extraction pipe connected to an intake of a gas treatment installation which provides a current of rich gas in particular containing hydrocarbons with a number of carbon atoms at least equal to three and yielding liquefied petroleum gases (LPG) and condensates, separated by a current of poor residual gas which is practically devoid of such hydrocarbons.

By using such installations, torch burning of the gases associated with crude oil is avoided, but the production of rich gas is proportional to the production of crude oil and it is not possible to modify the rate of gas production in accordance with the market demands for, respectively, crude oil on the one hand and for liquefied petroleum gas (LPG) and condensates on the other hand.

There is, therefore, a lack of flexibility in the existing installations which enable them to be adapted to market demands. In periods of low crude oil production, the production of liquefied petroleum gas and condensates should be able to exceed the limits presently imposed by the possibilities of associated gas extraction and should be able to provide better use of the large capacities of the gas treatment installations in order to meet the demand for this category of products.

Since an installation for the treatment of associated gases extracted from an installation for crude oil stabilization is generally not very far from said latter installation, with the distance not exceeding one kilometer, it has been imagined, in accordance with the present invention, to create the desired flexibility by means of recycling the gas from the gas treatment installation to the installation for crude oil stabilization.

One object of the invention is therefore a method for gas recycling in an installation for crude oil stabilization containing several gas/liquid separation stages, each connected to the following stage, traversed in series by a flow of crude oil from the first to the last stage and each provided with a gas removal pipe connected to the intake of a gas treatment installation which supplies a current of rich gas and a current of poor residual gas, wherein an adjustable part of said current of poor residual gas is injected into the crude oil flow upstream of at least one of the gas/liquid separation stages of the installation for crude oil separation.

This injection is preferably carried out between the penultimate stage and the last stage of gas/liquid separation of the installation for crude oil separation.

The mixture of recycled poor residual gas with the flow of crude oil in which it is injected can be carried out either directly into the pipe where the crude oil flow takes place if, up to the next separation stage, said pipe has a sufficient length in relation to its diameter (at least 100 times the diameter) or in a mixer connected to said pipe.

This injection of poor residual gas has a driving effect on the gases associated with the crude oil. These associated gases are progressively richer in hydrocarbons with a large number of carbon atoms when going from the first stage to the last stage of gas/liquid separation of the installation for crude oil stabilization. The recycled poor residual gas thus becomes saturated with hydrocarbons with a number of carbon atoms at least equal to three and brings an additional flow of rich gases into the gas treatment installation.

The volume of stabilized oil obtained is, of course, reduced. If it is desired to maintain the same production of stabilized oil, it is sufficient to increase slightly the rate of flow of crude oil at the intake of the stabilization installation, which further produces a proportional increase of rich gas recovered in the gas treatment installation.

By adjusting the rate of flow of the recycled poor residual gas, the production of rich gas can be adjusted and such can be adapted to the market demands independent of the production of stabilized crude oil. In addition, the gas treatment installations can operate at a higher capacity with improved yields.

An example of the operation of the method which is the object of the present invention is described below, as a non-limiting example, with reference to the attached drawings in which.

Figure 1:
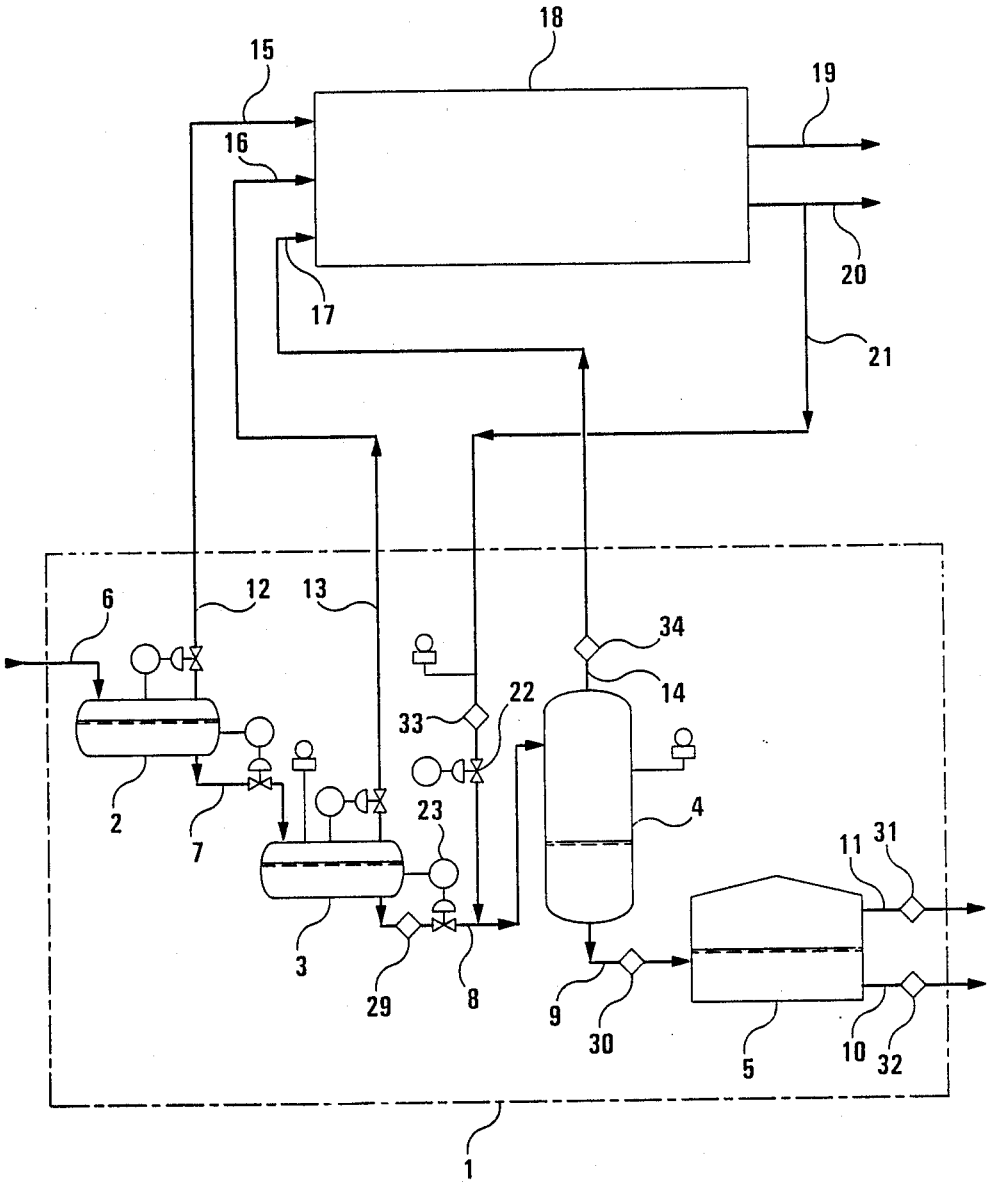
FIG. 1 is an overview of an installation for crude oil stabilization and a gas treatment installation.

In FIG. 1 an installation for the stabilization of crude oil 1 comprises a high pressure degassing flask 2 which constitutes the first gas/liquid separation stage, a medium pressure degassing flask 3 which constitutes a second gas/liquid separation stage, a low pressure degassing flask 4 which constitutes a third and last gas/liquid separation stage, which stage is at atmospheric pressure or close thereto and a stocking reservoir 5. Crude oil arrives from an oil well to an intake 6 of flask 2. The liquid separated from the gas in flask 2 flows through a pipe 7 into flask 3 where the liquid separated from the gas is taken by pipe 8 into flask 4. The liquid separated from the gas in flask 4 is taken by pipe 9 into the reservoir 5 which contains an exit 10 for the stabilized crude oil and an exit 11 for the gas which escapes from the crude oil into reservoir 5 and which is sent to a torch to be burned.

The gases associated with the crude oil which separate therefrom into flasks 2, 3 and 4 are collected in pipes 12, 13, 14, respectively. These pipes are connected to intakes 15, 16, 17, respectively, from a gas treatment installation which is a plant for natural gas liquids called LGN. This has not been shown in detail since it can be of various types which are well-known to those skilled in the art. At the exit of said installation 18 is shown the recovery at 19 of commercial rich gas (LPG and condensates) while at 20 a poor residual gas is removed.

An adjustable part of said poor residual gas is recycled through a pipe 21 provided with an adjustment valve 22 which exits into pipe 8, that is, upstream of flask 4, just downstream from the valve of the system 23 for adjustment of the level of liquid in the flask 3.

Figure 2:
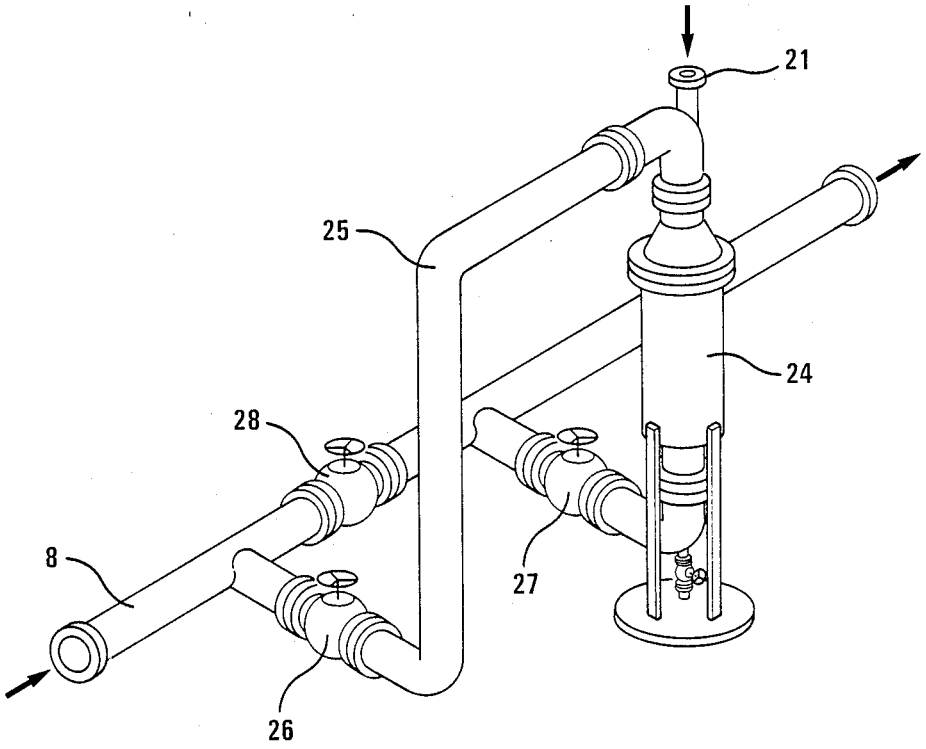
FIG. 2 represents the assembly of a mixer for the injection of poor residual gas.

The portion of pipe 8 between the junction with pipe 21 and flask 4 can be sufficiently long to ensure good mixing of the recycled gas and the crude oil prior to entry into flask 4. In any case, a thorough mixture of these two phases can be obtained by arranging a mixer 23 in a deviation 25 of pipe 8 by causing pipe 21 to exit into said deviation 25 upstream of mixer 24, while valves 26, 27, 28 enable the rate of flow of crude oil passing into the deviation 25 to be fixed (FIG. 2).

Pipe 21 exits upstream of flask 4 because, in this manner, the recycling of the poor residual gas is the most effective. The current of gas which exits from flask 4 through pipe 14 at a pressure close to atmospheric pressure is in equilibrium with the hydrocarbon dewpoint at the temperature existing in flask 4 (60° to 70° C.). The recycled poor residual gas is saturated with hydrocarbons with a high number of carbon atoms in the same proportion as the associated gas normally liberated in flask 4. Pipe 14 therefore brings an increased quantity of rich gas into installation 18 and the rate of flow of rich gas at 19 is increased by the same quantity.

Table 1 and Table 2 give an example of the composition of the rate of flow of fluid at various measurement points 29 to 34, respectively, without recycling of poor residual gases and with such recycling. This composition is given in kmoles per hour for a production of stabilized crude oil of 15,900 $m^3$ per day, as well as the pressure, the temperature, the molecular weight and the density. The measurement points are situated in the following manner: 29 on pipe 8, before the entry of the recycled gas if there is recycling; 30 on pipe 9, 31 on exit 11, 32 on exit 10, 33 on pipe 21, 34 on pipe 14. The rates of flow of water have not been given because all the passages of fluids, except for the passage of recycled gas (measurement 33), are saturated with water. In the case of Table 2, the recycling is carried out at the rate of 20 $m^3$ of gas under normal conditions per $m^3$ of stabilized crude oil. Certain components have been designated by their normal boiling point: PEN.

It can be seen on these tables that the molar flow rate of gas in supply pipe 14 of the gas treatment installation 18 is multiplied by three and the flow rate by weight is doubled by the effect of the recycling. This increase is due in part to the flow rate of the recycled gas but, in particular, to the hydrocarbons extracted from the crude oil by said recycled gas.

The quantity of hydrocarbons with a number of carbon atoms greater than three extracted from the crude oil by the recycled poor residual gas is 312 tons per day, of which approximately 75% are hydrocarbons with a number of carbons greater than five.

To compensate for the decrease in production of stabilized crude oil which the recycling would produce, the flow rate of crude oil at the intake 6 had to be increased by 2.8%.

The molecular weight of the gas exiting from flask 4 and sent into installation 18 through pipe 14 has decreased from 62.2 to 41.4 in the dry state and from 49.2 to 36.9 in the damp state, which has an impact on the compression equipment necessary in the gas treatment installation 18.

The temperature in the flask 4 has decreased by 8° C. due to the cooling effect of the evaporation of the saturation gases of the poor residual gas. This cooling reduces the degassing in the reservoir 5 to 17% in moles and to 12% by weight of what it would be without the recycling and therefore improves the recovery of stabilized oil.

Using a strict computer simulation of real conditions of operation, various graphs shown on FIGS. 3 to 7 were prepared which enable a better appreciation of the effects of the recycling. On all these drawings, the abscissa show a volume ratio between the recycled gas and the stabilized crude oil, which therefore provides data on the rate of recycling R. In addition, all these drawings show a curve HP corresponding to an injection of poor residual gas upstream of high pressure flask 2 and a curve LP corresponding to an injection of poor residual gas upstream of low pressure flask 4. This latter injection is the one shown in FIG. 1.

Figure 3:
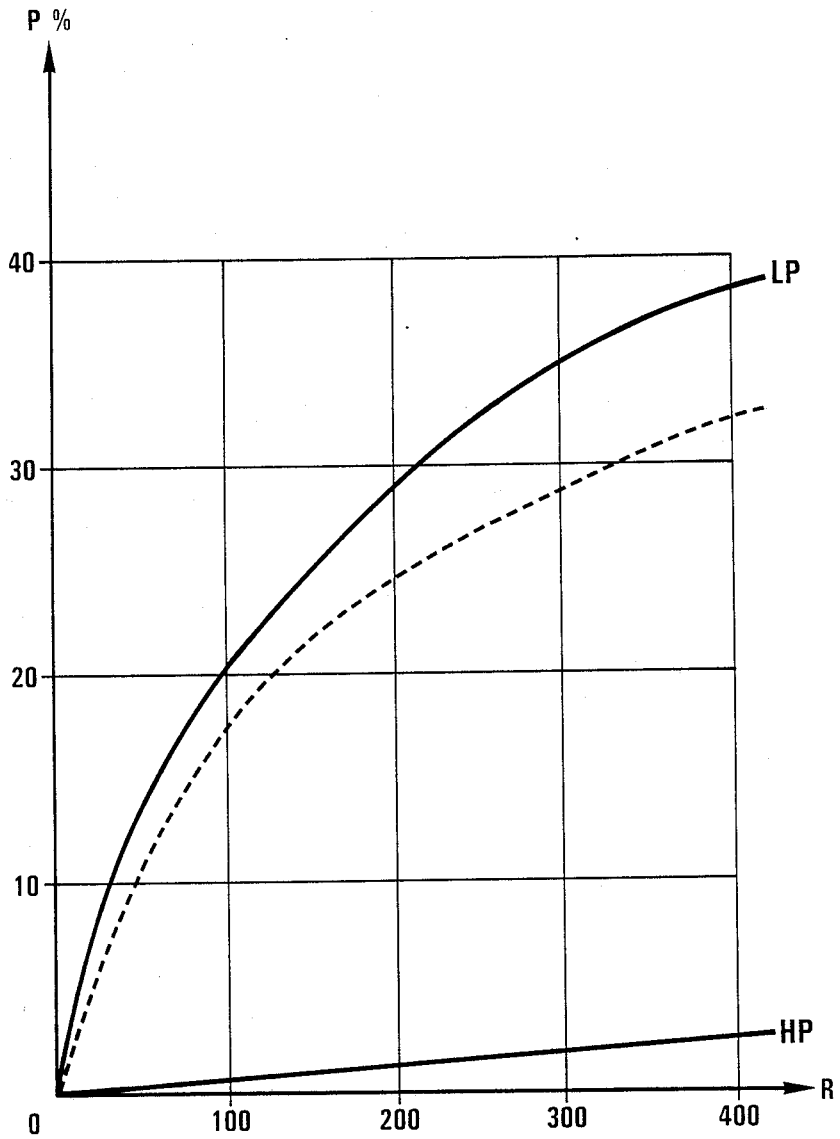
FIGS. 3 to 7 represent graphs showing the variation of various parameters as a function of the rate of poor residual gas recycling for an injection of poor residual gas upstream of the first gas/liquid separation stage and for an injection of poor residual gas upstream of the last gas/liquid separation stage of the oil stabilization installation.

FIG. 3 uses ordinates to show the percentage by weight P % of the increase in production of LPG and condensates due to the recycling. The dotted line between the two curves HP and LP corresponds to the case when one half of the recycled poor residual gas is injected upstream of flask 2 and the other half upstream of flask 4. The exactitude of these results was able to be checked by tests on a real installation. The interest is clearly demonstrated of an injection of recycled gas upstream of the last gas/liquid separation stage of the stabilization installation.

Figure 4:
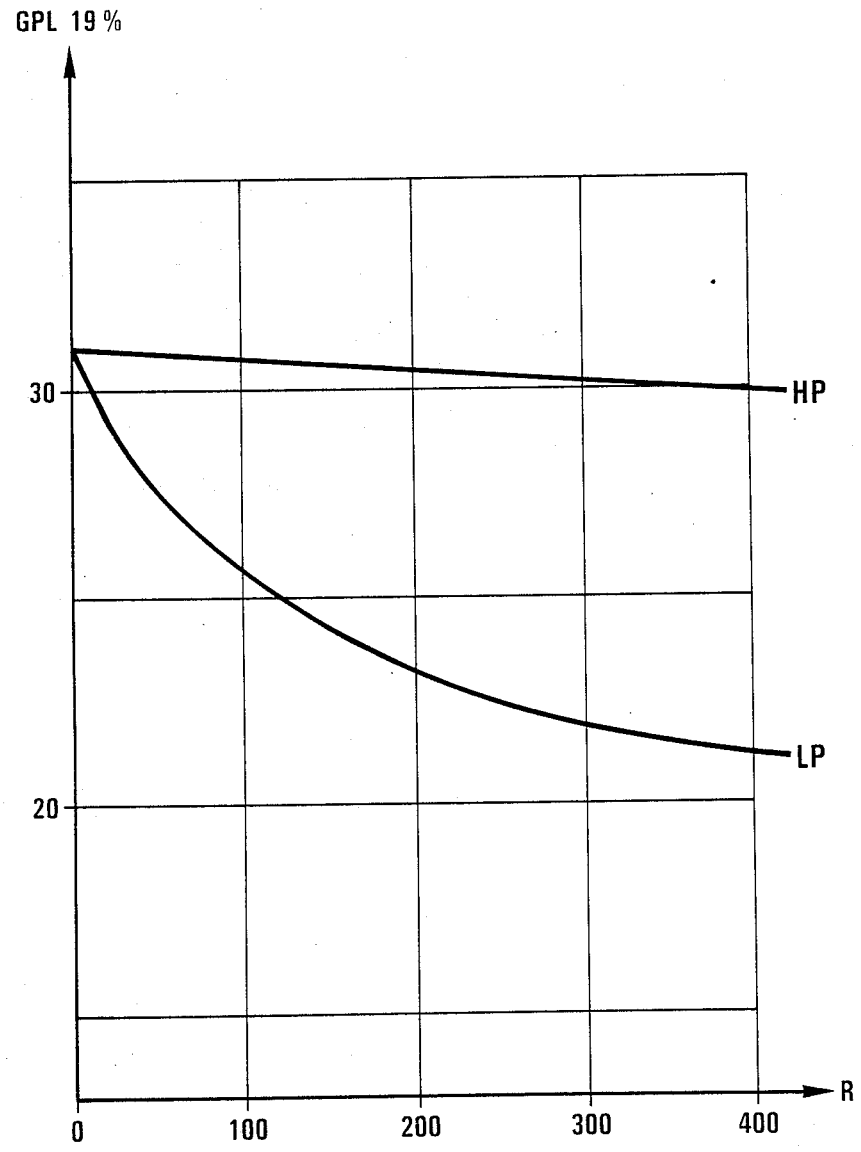

FIG. 4 shows the percentage of LPG in the total additional production of LPG and condensates due to the recycling. It can be seen that high recycling increases the production of pentanes and condensates by relatively more than LPG.

Figure 5:
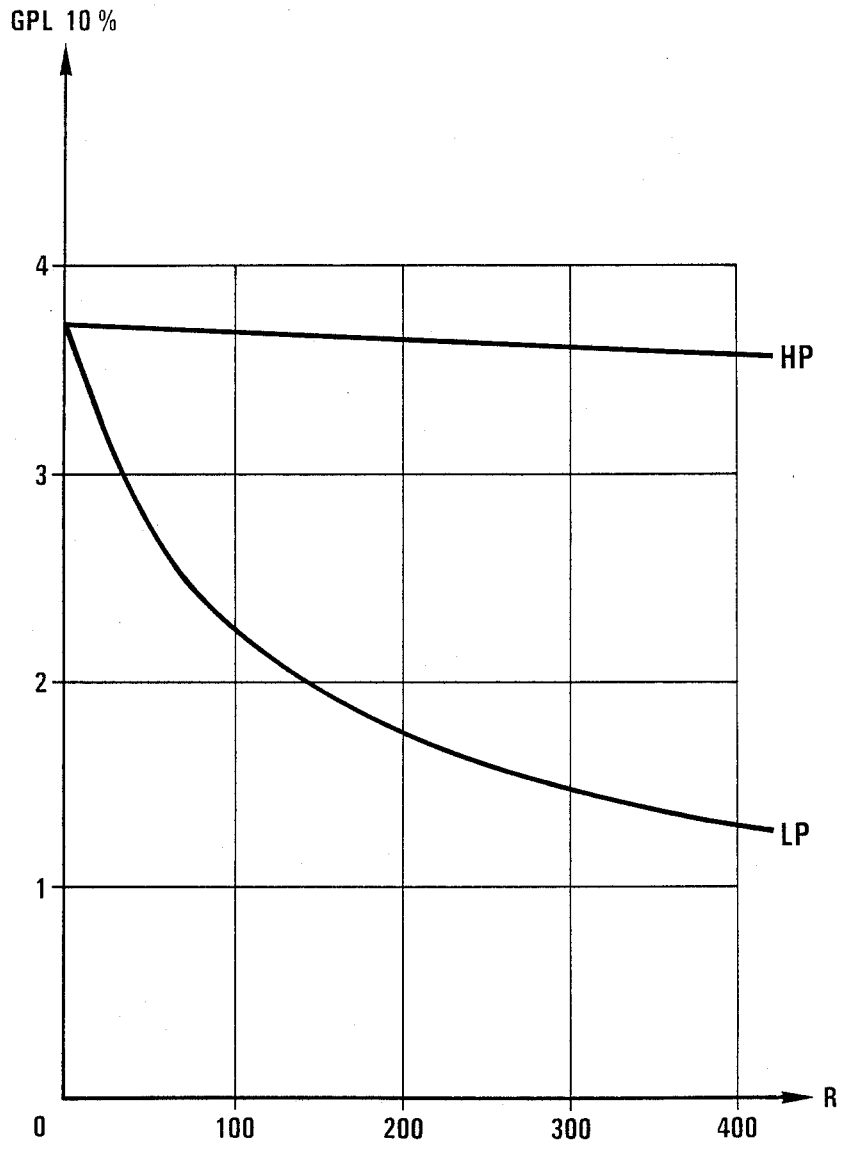
Figure 6:
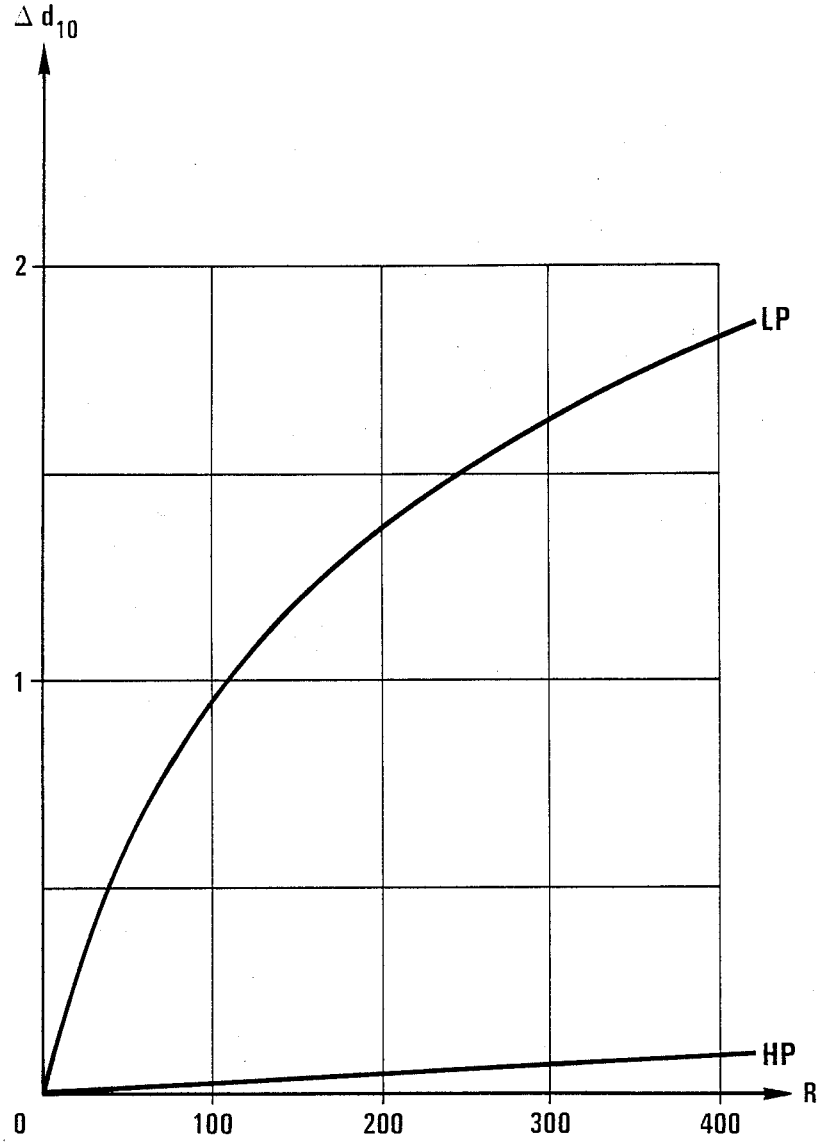

FIGS. 5 and 6 relate to the effect of the recycling on the stabilized crude oil obtained at exit 10. FIG. 5 gives the molar percentage of LPG contained in the stabilized crude oil. It can be seen that this percentage decreases when the recycling increases, which is natural since there is a greater driving effect exerted by the recycled gas. FIG. 6 gives the variation in the density of the stabilized crude oil due to the recycling. This variation in density increases when the recycling increases.

Figure 7:
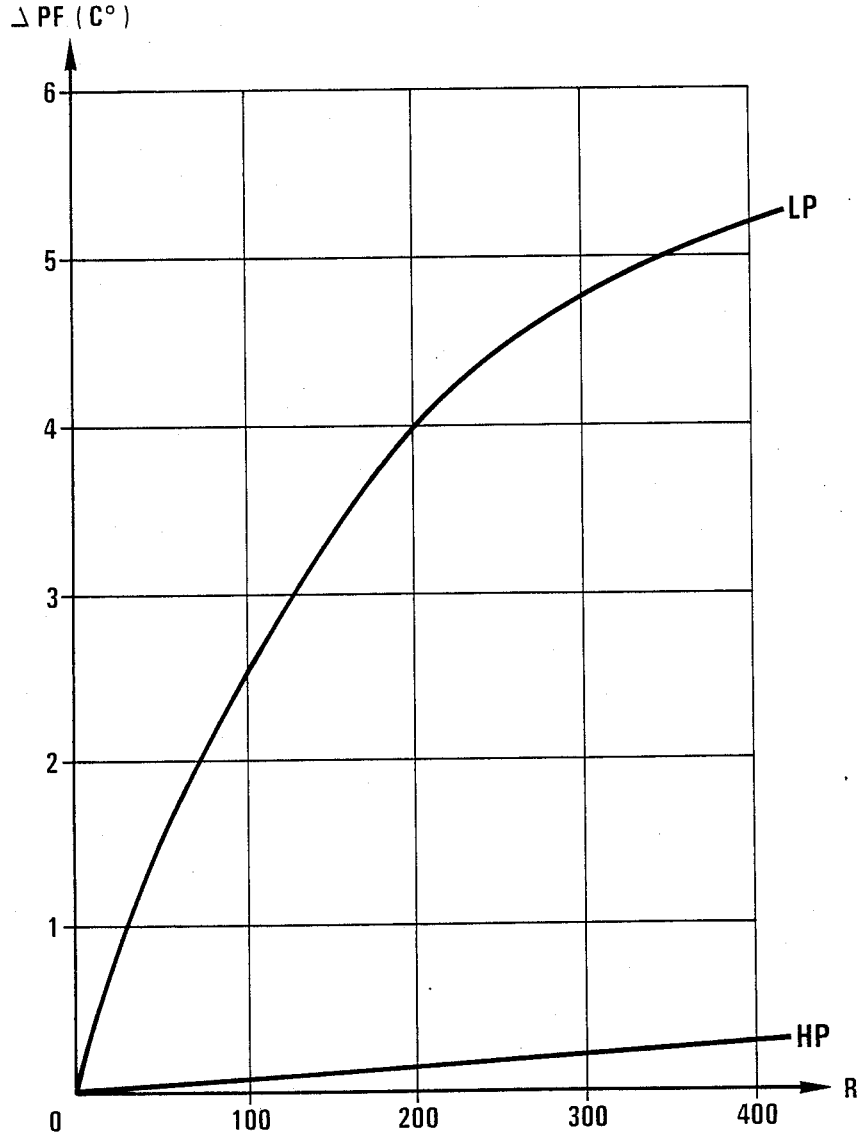

FIG. 7 shows the variation in quality of the additional condensate produced by the recycling. The variation of the final point PF of distillation of said condensate has been shown by ordinates. This point is higher when the recycling increases due to the fact that the recycled gas removes heavier and heavier hydrocarbons.

Table 3 gives the results of the application of recycling of poor residual gas from the LGN installation to the installation for crude oil stabilization for each of three fields of production A, B, C each provided with a stabilization installation and a gas treatment installation supplied with the associated gases extracted from the crude oil in the stabilization installation. It has been assumed that each of the three fields operated below their nominal capacity and an optimal scenario has been provided where the recycling rate, which is different for each field, reaches the nominal capacities of the LGN installations.

Said Table 3 shows, on the one hand, the situation without recycling and, on the other hand, the scenario with this optimal recycling. The rate of recycling R given is equal to 5.62 times the ratio between the volume of recycled gas and the volume of stabilized crude oil expressed in the same unit of volume, for example in $m^3$. It is also the rate R which has been shown on FIGS. 3 to 7 and it was selected because it can be directly obtained in the manner in which, in practice, the measurement of these two volumes is generally carried out.

When there is no recycling, there is a production of 6323 tons per day of LPG and condensates and 79490 $m^3$ per day of stabilized crude oil.

With the recycling, an additional quantity of LPG and condensates of 1701 tons per day can be xtracted from the crude oil, which represents an increase of approximately 27%. In order to maintain the same production of stabilized crude oil, the rate of flow of the wells of fields A, B, C must be increased by less than 3% by volume.

TABLE 1

| Measurement points | 29 | 30 | 31 | 32 | 33 | 34 |
|---|---|---|---|---|---|---|
| Nitrogen kmoles/h | 0.00 | 0.00 | 0.00 | 0.00 | | 0.00 |
| Carbon dioxide kmoles/h | 3.06 | 0.16 | 0.07 | 0.09 | | 2.90 |
| Sulfurated hydrogen kmoles/h | 0.00 | 0.00 | 0.00 | 0.00 | | 0.00 |
| Methane kmoles/h | 16.06 | 0.44 | 0.27 | 0.17 | | 15.62 |
| Ethane kmoles/h | 29.75 | 3.08 | 0.86 | 2.22 | | 26.67 |
| Propane kmoles/h | 97.80 | 23.81 | 2.89 | 20.32 | | 75.99 |
| Butanes kmoles/h | 181.98 | 82.52 | 4.18 | 78.34 | | 99.46 |
| Pentanes kmoles/h | 114.09 | 77.81 | 1.57 | 76.24 | | 36.28 |
| Hexanes kmoles/h | 51.27 | 44.11 | 0.31 | 43.80 | | 7.16 |
| Heptanes and more kmoles/h | 39.57 | 37.86 | 0.07 | 37.79 | | 1.71 |
| PEN 42° C. | 196.22 | 145.38 | 2.21 | 143.17 | | 50.84 |
| PEN 69° C. | 96.01 | 83.16 | 0.56 | 82.60 | | 12.85 |
| PEN 83° C. | 99.98 | 90.68 | 0.41 | 90.27 | | 9.30 |
| PEN 94° C. | 150.67 | 121.97 | 0.38 | 121.59 | | 8.70 |
| PEN 105° C. | 2194.88 | 2179.36 | 0.68 | 2178.68 | | 15.52 |
| TOTAL kmoles/h | 3251.34 | 2890.54 | 14.46 | 2875.88 | | 361.00 |
| TOTAL tons/h | 569.74 | 547.65 | 0.92 | 546.73 | | 22.09 |
| Pressure (bars) | 4.1 | 1.1 | 1.013 | 1.013 | | 1.1 |
| Temperature °C. | 80 | 70 | 69 | 69 | | 70 |
| Molecular weight (dry/damp gas) | — | — | 63.6/50.1 | | | 61.2/49.2 |
| Density (liquid) | 0.815 | 0.828 | | 0.829 | | |
| Dry/damp gas $m^3$/day | | | 8210/11610 | | | 203900/283200 |
| $m^3$/day | 16860 | 15900 | | 15900 | | |

TABLE 2

| Measurement points | 29 | 30 | 31 | 32 | 33 | 34 |
|---|---|---|---|---|---|---|
| Nitrogen kmoles/h | 0.00 | 0.01 | 0.00 | 0.01 | 2.81 | 2.80 |
| Carbon dioxide kmoles/h | 3.15 | 0.62 | 0.07 | 0.55 | 28.30 | 30.83 |
| Sulfurated hydrogen kmoles/h | 0.00 | 0.00 | 0.00 | 0.00 | 0.00 | 0.00 |
| Methane kmoles/h | 16.53 | 5.13 | 0.97 | 4.16 | 494.23 | 505.63 |
| Ethane kmoles/h | 30.62 | 3.97 | 0.21 | 3.76 | 63.95 | 90.60 |
| Propane kmoles/h | 100.67 | 12.23 | 0.23 | 12.00 | 7.46 | 95.90 |
| Butanes kmoles/n | 187.32 | 47.96 | 0.33 | 47.63 | 0.36 | 139.72 |
| Pentanes kmoles/h | 117.44 | 56.37 | 0.15 | 56.22 | 0.00 | 61.07 |
| Hexanes kmoles/h | 52.78 | 38.78 | 0.03 | 38.75 | 0.00 | 14.00 |
| Heptanes and more kmoles/h | 40.73 | 37.22 | 0.01 | 37.21 | 0.00 | 3.51 |

TABLE 2-continued

| Measurement points | 29 | 30 | 31 | 32 | 33 | 34 |
|---|---|---|---|---|---|---|
| PEN 42° C. | 201.98 | 111.90 | 0.22 | 111.68 | 0.00 | 90.08 |
| PEN 69° C. | 98.83 | 73.57 | 0.06 | 73.51 | 0.00 | 25.26 |
| PEN 83° C. | 102.91 | 84.10 | 0.05 | 84.05 | 0.00 | 18.81 |
| PEN 94° C. | 134.51 | 116.65 | 0.04 | 116.61 | 0.00 | 17.86 |
| PEN 105° C. | 2259.32 | 2227.65 | 0.08 | 2227.57 | 0.00 | 31.67 |
| TOTAL kmoles/h | 3346.79 | 2816.16 | 2.45 | 2813.71 | 597.11 | 1127.74 |
| TOTAL tons/h | 586.47 | 551.29 | 0.11 | 551.18 | 11.53 | |
| Pressure (bars) | 4.1 | 1.1 | 1.013 | 1.013 | 19 | 1.1 |
| Temperature °C. | 801 | 62 | 62 | 62 | 51 | 62 |
| Molecular weight (dry/damp gas) | — | — | 43.8/38.4 | | 19.3/19.3 | 41.4/36.9 |
| Density (liquid) | 0.815 | 0.834 | | 0.834 | | |
| Dry/damp gas $m^3$/day | | | 1410/1700 | | 339800/339800 | 640030/795790 |
| $m^3$/day | 17340 | 15900 | | 15900 | | |

TABLE 3

| SITE | A | B | C | TOTAL |
|---|---|---|---|---|
| Scenario with recycling | | | | |
| Final daily production of crude oil $km^3$ | 36.57 | 2.38 | 40.54 | 79.49 |
| Additional daily flow at the well head $km^3$ | 1.59 | 0.16 | 1.27 | 3.02 |
| % Volume increase in flow at the well head | 3.25 | 4.33 | 2.36 | 2.84 |
| Increase in daily production in tons of LPG + $C_{5+}$ | 906 | 74 | 721 | 1701 |
| % Increase by weight of LPG + $C_{5+}$ | 28 | 39 | 25 | 27 |
| Recycling rate R | 120 | 150 | 70 | 95 |
| Situation without recycling | | | | |
| Daily production in tons of LPG + $C_{5+}$ | 3210 | 189 | 2924 | 6323 |

TABLE 3-continued

| SITE | A | B | C | TOTAL |
|---|---|---|---|---|
| Daily production crude oil $km^3$ | 36.57 | 2.38 | 40.54 | 79.49 |

I claim:

1. A method for recycling gas in an installation for crude oil stabilization containing several gas/liquid separation stage each connected to the following stage, traversed in series by a flow of crude oil from the first to the last stage and each provided with a gas removal pipe connected to the intake of a gas treatment installation which provides a current of rich gas and a current of poor residual gas, characterized in that an adjustable part of said current of poor residual gas is injected into the flow of crude oil upstream of at least one of the gas/liquid separation stages of the installation for crude oil stabilization.

2. The recycling method in accordance with claim 1, wherein the injection of poor residual gas is carried out between the penultimate and the last gas/liquid separation stage of the installation for crude oil stabilization.

* * * * *